United States Patent [19]

Iwata

[11] Patent Number: 4,774,925

[45] Date of Patent: Oct. 4, 1988

[54] IGNITION CONTROL DEVICE

[75] Inventor: Toshio Iwata, Himeji, Japan

[73] Assignee: Mitsubishi Denki Kabushiki Kaisha, Tokyo, Japan

[21] Appl. No.: 493

[22] Filed: Jan. 5, 1987

[30] Foreign Application Priority Data

Jan. 28, 1986 [JP] Japan ..... 61-18460

[51] Int. Cl.[4] ..... F02P 3/055

[52] U.S. Cl. ..... 123/644; 123/632

[58] Field of Search ..... 123/644, 632, 146.5 D

[56] References Cited

U.S. PATENT DOCUMENTS 4,402,299 9/1983 Nakao et al. ..... 123/644

*Primary Examiner*—Andrew M. Dolinar

*Attorney, Agent, or Firm*—Sughrue, Mion, Zinn, Macpeak and Seas

[57] ABSTRACT

An ignition control device for an internal combustion engine includes a digital control circuit which functions to reduce gradually a current flowing through a primary side of an ignition coil when a current supply to the primary side of the ignition coil continues for a time longer than a normal current supply period, to thereby prevent undesired spark discharge from occurring in an ignition plug.

2 Claims, 2 Drawing Sheets

IGNITION CONTROL DEVICE

BACKGROUND OF THE INVENTION

The present invention relates to an ignition control device for an internal combustion engine, which is capable of cutting a current flowing through a primary side of an ignition coil without producing a spark in an ignition plug connected to a secondary side of the ignition coil.

An induction type ignition device which is widely used for the internal combustion engine employs an ignition coil having a primary winding and a secondary winding connected to an ignition plug so that, when an electric current flowing through the primary winding is cut off, a high voltage is induced across the secondary winding by which a spark discharge occurs across opposite electrodes of the ignition plug connected thereto.

The current flowing through the primary winding is on-off controlled usually by a semiconductor switching element. It becomes possible recently to control a time period for which the current flows through the primary winding and to regulate a value of the current flowing actually therethrough at a time when it is to be cut off to a certain level by means of electronics.

With the development of electronic engineering, an ignition control device by which a current flowing through the primary winding is made large enough to enable a high energy ignition has been realized.

In such ignition control device capable of using a large primary current, there is a defect that at a closure of a power switch or at a time when an engine stops to rotate such large primary current still remains in the primary winding, a value of which is still controlled by the ignition control device to a predetermined value, resulting in an over-heating and damage of the ignition coil and/or the control device.

In order to avoid such problem by cutting the primary current of the ignition coil off, an ignition energy is produced in the secondary side of the ignition coil by which an undesired spark is produced in the spark plug. If such spark occurs in a suction stroke of the engine, problems such as blowback of engine will occur.

Japanese Patent Application Laid-Open No. 18545/1977 discloses an ignition control device of analog type in which a primary current is reduced gradually when an engine stops to operate so that there is no such undesired spark. However, the proposed ignition control device uses a capacitor voltage to analog-control the primary current, together with a number of analog circuit elements. Therefore, an operation of the device is influenced largely by variations of these elements and tends to become unstable.

SUMMARY OF THE INVENTION

An object of the present invention is to provide an ignition control device of digital type which is simple in construction comparing with a conventional analog type ignition control device and is capable of reducing a current flowing through a primary winding of an ignition coil gradually by means of a conventional current limiting circuit.

According to the present invention, the ignition control device includes an ignition signal generator, a switching circuit having an input connected to the ignition signal generator and a feedback circuit acting as a current limiting circuit, means for detecting a current flowing through a primary winding of an ignition coil so that the current is controlled to a predetermined current limiting value and means for changing the predetermined current limiting value to gradually reduce and ultimately cut off the current in the primary winding.

DETAILED DESCRIPTION OF THE PREFERRED EMBODIMENTS

Figure 1:
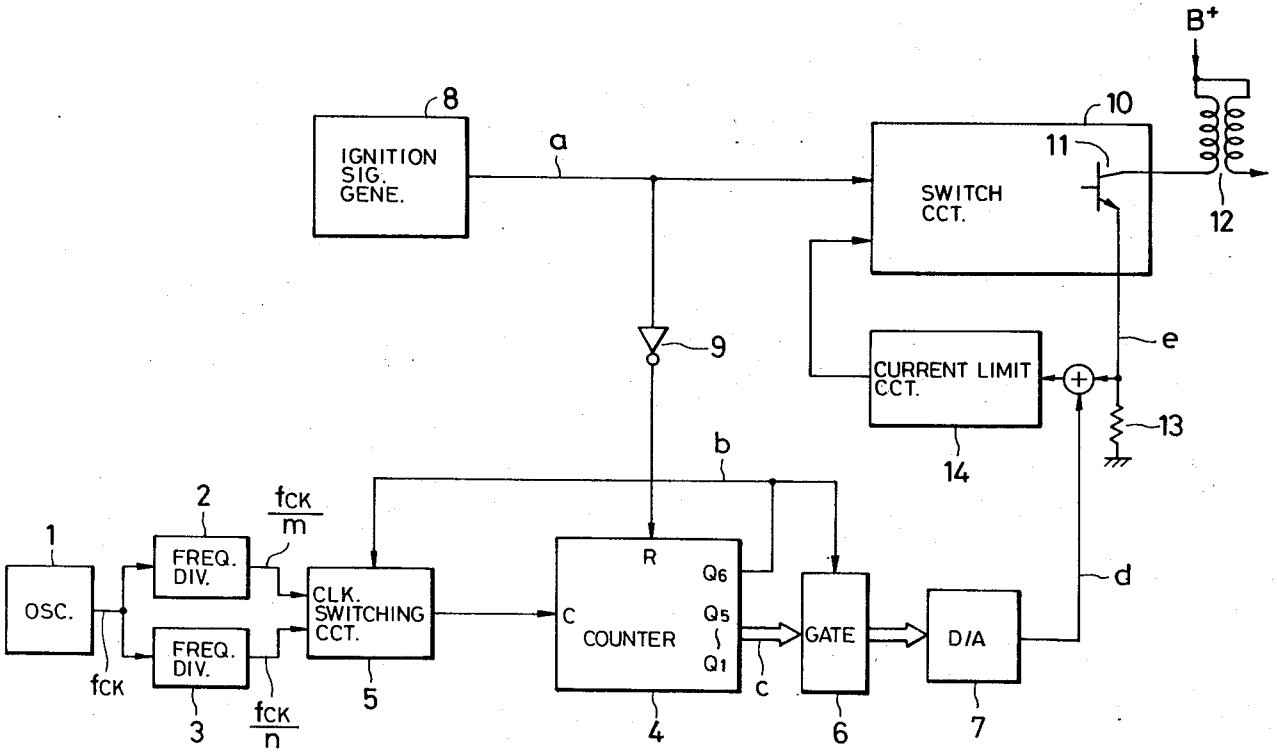
FIG. 1 is a block circuit diagram showing an embodiment of an ignition control device for an internal combustion engine, according to the present invention.

In FIG. 1, the present ignition control device comprises an oscillator 1 for producing a clock pulse signal having frequency $f_{CK}$ and frequency dividers 2 and 3 connected to an output of the oscillator 1. The frequency dividers 2 and 3 function to divide the clock pulse signal frequency by integers m and n which is smaller than m, respectively, to provide clock signals of $f_{CK}/m$ and $f_{CK}/n$ which are supplied to a clock switching circuit 5.

A counter 4 has a clock input terminal C, a reset input terminal R and a set of output terminals $Q_1$ for least significant digit to $Q_6$ for most significant digit.

The clock switching circuit 5 has three input terminals, the first and second thereof being connected to the outputs of the frequency dividers 2 and 3, respectively, and the third input terminal being connected to the output terminal $Q_6$ of the counter 4. An output of the clock switching circuit 5 is connected to the clock terminal C of the counter 4.

Count outputs at the terminals $Q_1$ to $Q_5$ of the counter 4 are supplied to a gate 6 having an output connected to a digital/analog (D/A) converter 7 in which the count outputs are converted into an analog voltage.

An ignition signal generator 8 responds to a signal synchronized with an engine rotation to provide an output signal (ignition signal) indicative of a current supply period for the ignition coil.

The ignition signal is inverted by an inverter 9 and supplied to the reset terminal R of the counter 4 to reset the latter at a trailing edge of the ignition signal. The ignition signal is also supplied to a switching circuit 10 including a power transistor 11 to on-off control a current in a primary side of the ignition coil 12 in synchronism therewith.

A current limiting circuit 14 is supplied with a voltage produced at a current detecting resistor 13 connected in series with the output transistor 11 of the switching circuit 10 and feeds it back to the switching circuit 10 to regulate the current in the ignition coil 12 to a predetermined value. To the voltage supplied to the current limiting circuit 14, an output voltage of the D/A converter 7 is added.

An operation of the ignition control device shown in FIG. 1 will be described with reference to the waveforms shown in FIG. 2.

Figure 2:
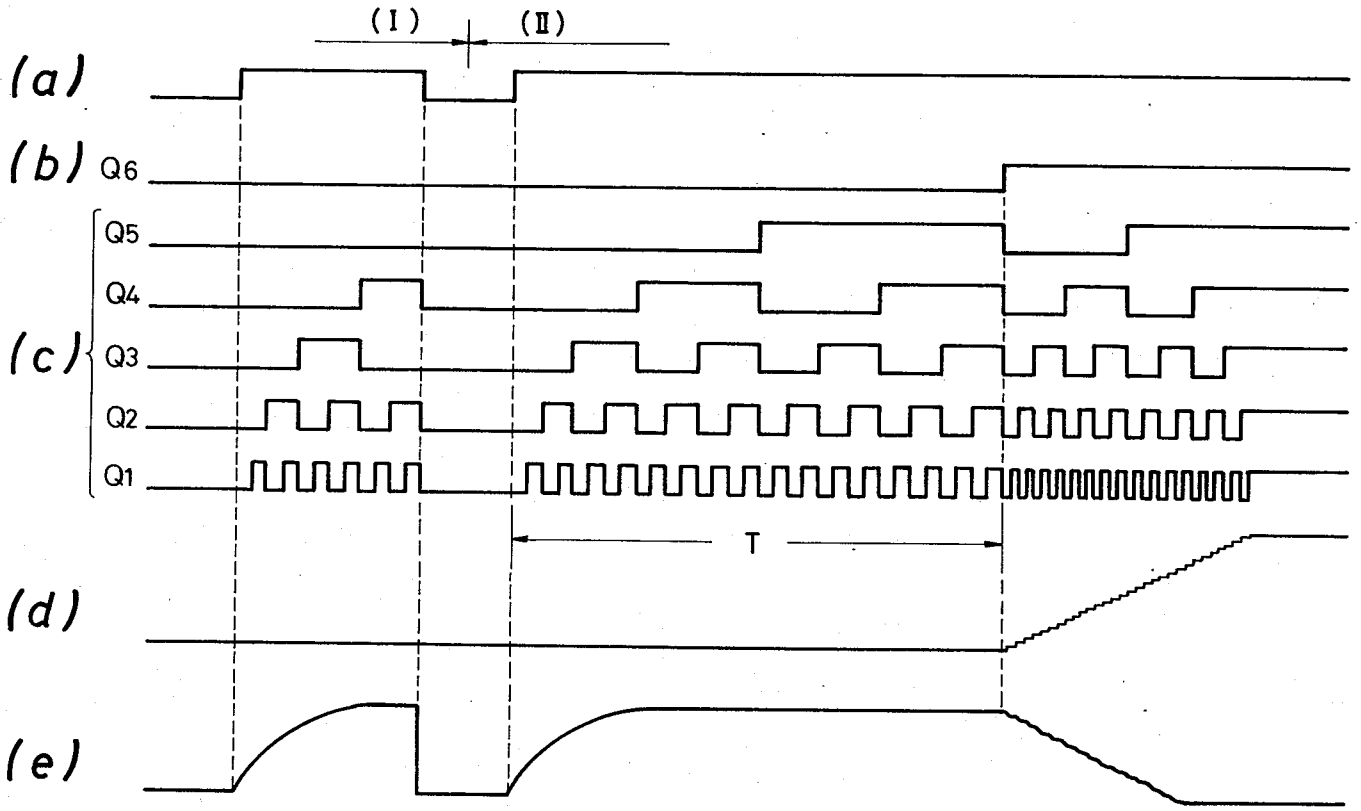
FIG. 2 shows waveforms at various points in the circuit in FIG. 1 for explaining an operation thereof.

In FIG. 2, waveforms a to e show voltages at points a to e of the circuit in FIG. 1, respectively, in which the waveform a corresponds to the ignition signal at the output of the ignition signal generator 8, the waveform b corresponds to the output at the terminal $Q_6$ of the counter 4 and the waveform c corresponds to the count outputs at the terminals $Q_1$ to $Q_5$ of the counter 4.

The waveforms d and e correspond to the output voltage of the D/A converter 7 and the current in the primary side of the ignition coil 12, respectively.

Assuming that the engine is rotating, a high level portion of the ignition signal a indicates the current supply period, as shown in a time period I, with leading and trailing edges thereof showing a current supply start time and a current cut off time, respectively. The switching circuit 10 operates in synchronism with the high level portion of the ignition signal a during which time the power transistor 11 is conductive to allow a current to flow through the primary side of the ignition coil 12 as shown by the waveform e in the time period I.

On the other hand, the counter 4 is made inoperative by the inverter 9 during a low level portion of the ignition signal a as shown by the waveform c and counts the clock pulse signal of either $f_{CK}m$ or $f_{CK}/n$ from the clock switching circuit during the high level portion of the signal a.

The clock switching circuit 5 responds to the output of the terminal $Q_6$ of the counter 4 to provide the clock of $f_{CK}/m$ when the output at the terminal $Q_6$ is in low level and provide the clock $f_{CK}/n$ when the level of the output at the terminal $Q_6$ is high.

The frequency dividing ratio 1/m of the frequency divider 2 is fixed at a value such that it is small enough to prevent the output at the terminal $Q_6$ from becoming high within a time period such as engine start time period which is shorter than the ignition period even when the counter 4 counts the clock of $f_{CK}/m$. That is, when the engine is rotating normally, the counter 4 counts the clock of $f_{CK}/m$ when the ignition signal a is in high level. However, there is no high output provided at the terminal $Q_6$ of the counter 4 as shown by the waveform b in the time period I.

The gate 6 is opened when the terminal $Q_6$ provides a high level output and closed when it becomes low. Therefore, during the time period I in which there is no high output at the terminal $Q_6$ of the counter 4, the output voltage of the D/A converter 7 is null as shown by the waveform d in the time period I.

On the other hand, when the engine stops to rotate with the ignition signal a at a high level, the switching circuit 10 tends to keep the current supply to the ignition coil 12 and the current limiting circuit 14 also continues to regulate the current supplied to the constant value, as shown in a time period II in FIG. 2.

According to the present invention, however, the counter 4 provides a high level signal at the terminal $Q_6$ thereof after a time T, which is, in this embodiment, 32 $m/f_{CK}$, from the current supply start time. Therefore, the clock switching circuit 5 switches the clock output from the frequency divider 2 to the frequency divider 3 and the gate 6 is opened so that the count contents at the terminals $Q_1$ to $Q_5$ of the counter 4 are allowed to pass therethrough to the D/A converter 7. The time T can be selected as described so long as it is longer than the normal ignition current supply period. The counter 4 counts the clock pulse of $f_{CK}/n$ from the frequency divider 3 and the D/A converter 7 provides an output corresponding to the count content of the counter 4, as shown by the waveform d in the time period II in FIG. 2.

The output voltage of the D/A converter 7 is added to the terminal voltage of the current detecting resistor 13 and supplied to the input of the current limiting circuit 14.

Since the output voltage of the D/A converter 7 increases gradually as shown, an output of the current limiting circuit 14 increases to gradually increase an amount of feedback to the switching circuit 10 as if the current flowing through the primary side of the ignition coil 12 increases. As a result, the current flowing through the primary side of the ignition coil 12 is gradually decreased as shown by the waveform e in the time period II and ultimately becomes zero. Therefore, there is no high voltage ignition energy produced in the secondary side of the ignition coil 12 and thus there is no spark produced in the ignition plug.

In this manner, when the engine rotates, the switching circuit 10 responds to the ignition signal to on-off control the current supply to the primary side of the ignition coil 12 as shown in the time period I in FIG. 2 and, when the engine stops at a time instance after the time T from the start of the current supply period, the gradually increasing voltage is supplied to the current limiting circuit 14 to reduce the current in the primary side of the ignition coil 12 gradually to thereby prevent undesired spark discharge from occurring in the ignition plug.

The present ignition control device is featured by comprising, in addition to the ignition signal generator 8, the switching circuit 10 and the current limiting circuit 14 which are used in the conventional device, the inverter 9 having the input connected to the output terminal of the ignition signal generator 8, the D/A converter 7 having the output connected to the input terminal of the current limiting circuit 14 so that it is added to the output of the current detecting resistor 13 and the digital control circuit including the oscillator 1, the frequency dividers 2 and 3, the counter 4, the gate 6 and the D/A converter 7. The operation of such digital circuit is stable regardless of variations of circuit elements and/or changes of characteristics thereof with time. Furthermore, the setting of the time period T can be done arbitrarily by using such digital circuit without difficulty.

Although the present invention has been described as being applied when the engine stops to rotate, it is also operable when the ignition coil becomes conductive at a time when the power switch is closed.

The ignition signal generator 8, the switching circuit 10, the current limiting circuit 14 and the digital control circuit added thereto according to the present invention may be prepared as discrete components, respectively, or may be fabricated as any combinatioan thereof or as a single unit.

As described hereinbefore, according to the present invention, the current supply to the ignition coil is gradually decreased when the current supply time period of the ignition coil becomes equal to the predetermined time length. Therefore, the current in the primary side of the ignition coil is cut off without producing undesired spark discharge in the secondary side thereof. The ignition control device according to the present invention is simple in construction and can be realized without substantial change of circuit design of the conventional ignition control device.

What is claimed is:

1. An ignition control device for an internal combustion engine, comprising: switching means (10, 11) for on-off controlling a current supply to an ignition coil (12) in synchronism with an engine rotation, current limiting means (13) for detecting a current flowing through said ignition coil to regulate the current to a predetermined value, and means for changing said predetermined value to reduce the current gradually, wherein said changing means comprises an oscillator (1), a first frequency divider (2) for dividing an output signal frequency of said oscillator by a first integer, a second frequency divider (3) for dividing said output signal frequency of said oscillator by a second integer, said second integer being smaller than said first integer, a clock switching circuit (5) for outputting either of an output of said first frequency divider or an output of said second frequency divider, a counter (4) having an input connected to an output of said clock switching circuit and at least two-digit outputs, said clock switching circuit being responsive to a higher digit output (Q6) of said counter to switch from said first frequency divider to said second frequency divider, a gate (6) responsive to said higher digit output of said counter to pass said lower digit output, a digital to analog converter (7) having an input connected to an output of said gate, and an adder for adding an output of said digital to analog converter to an input of said current limiting means.

2. The ignition control device as claimed in claim 1, wherein said changing means includes a timer circuit for graduallyl decreasing the current when the current is supplied for a time equal to a predetermined time.

* * * * *